US005277552A

United States Patent [19]

Higuchi

[11] Patent Number: 5,277,552

[45] Date of Patent: Jan. 11, 1994

[54] SLANT PLATE TYPE COMPRESSOR WITH VARIABLE DISPLACEMENT MECHANISM

[75] Inventor: Teruo Higuchi, Isesaki, Japan

[73] Assignee: Sanden Corporation, Gunma, Japan

[21] Appl. No.: 881,081

[22] Filed: May 11, 1992

[30] Foreign Application Priority Data

May 17, 1991 [JP] Japan ..... 3-140746

[51] Int. Cl.[5] ..... F04B 1/26

[52] U.S. Cl. ..... 417/222.2; 417/269

[58] Field of Search ..... 417/222S, 269; 717/222.1, 222.2, 269

[56] References Cited

U.S. PATENT DOCUMENTS

| | | | |
|---|---|---|---|
| 3,062,020 | 11/1962 | Heidorn | 417/222 |
| 4,037,993 | 7/1977 | Roberts | 417/222 |
| 4,061,443 | 12/1977 | Black et al. | 417/222 |
| 4,174,191 | 11/1979 | Roberts | 417/222 |
| 4,231,713 | 11/1980 | Widdowson et al. | 417/222 |
| 4,257,795 | 3/1981 | Shaw | 62/150 |
| 4,480,964 | 11/1984 | Skinner | 417/222 |
| 4,606,705 | 8/1986 | Parekh | 417/222 |
| 4,685,866 | 8/1987 | Takenaka et al. | 417/222 |
| 4,688,997 | 8/1987 | Suzuki et al. | 417/222 |
| 4,702,677 | 10/1987 | Takenaka et al. | 417/222 |
| 4,723,891 | 2/1988 | Takenaka et al. | 417/222 |
| 4,732,544 | 3/1988 | Kurosawa et al. | 417/270 X |
| 4,913,626 | 4/1990 | Terauchi | 417/222 |
| 4,913,627 | 4/1990 | Terauchi | 417/222 |
| 4,936,752 | 6/1990 | Terauchi | 417/222 |
| 4,960,367 | 10/1990 | Terauchi | 417/270 |
| 5,092,741 | 3/1992 | Taguchi | 417/222 |

FOREIGN PATENT DOCUMENTS

| | | |
|---|---|---|
| 0300831 | 1/1980 | European Pat. Off. . |
| 61-055380 | 3/1986 | Japan . |
| 61-145379 | 7/1986 | Japan . |
| 1-142276 | 6/1989 | Japan . |
| 2019043 | 10/1979 | United Kingdom . |

*Primary Examiner*—Richard A. Bertsch
*Assistant Examiner*—Peter Korytnyk
*Attorney, Agent, or Firm*—Baker & Botts

[57] ABSTRACT

A slant plate type compressor with a capacity or displacement adjusting mechanism is disclosed. The compressor includes a housing having a cylinder block provided with a plurality of cylinders and a crank chamber. A piston is slidably fitted within each of the cylinders and is reciprocated by a drive mechanism which includes a member having a surface with an adjustable incline angle. The incline angle is controlled by the pressure situation in the crank chamber. The pressure in the crank chamber is controlled by a control mechanism which comprises a passageway communicating between the crank chamber and a suction chamber and a valve device to control the closing and opening of the passageway. The valve device includes a valve element which directly controls the closing and opening of the passageway. The valve device further includes a first bellows and a second bellows. The second bellows receives the discharge chamber pressure without an intrusion of the discharge chamber pressure into the passageway, and is coupled to the first bellows to apply a force to the first bellows and thereby shift a control point of the first bellows in response to changes in the discharge chamber pressure.

24 Claims, 6 Drawing Sheets

SLANT PLATE TYPE COMPRESSOR WITH VARIABLE DISPLACEMENT MECHANISM

BACKGROUND OF THE INVENTION

1. Field of the Invention

The present invention relates to a refrigerant compressor, and more particularly, to a slant plate type compressor, such as a wobble plate type compressor with a variable displacement mechanism suitable for use in an automotive air conditioning system.

2. Description of the Prior Art

A wobble plate type refrigerant compressor with a variable displacement mechanism as illustrated in FIG. 1 is disclosed in U.S. Pat. No. 4,960,367 to Terauchi. For purposes of explanation only, the left side of the Figure will be referenced as the forward end or front end and the right side of the Figure will be referenced as the rearward end.

Compressor 10 includes cylindrical housing assembly 20 including cylinder block 21, front end plate 23 at one end of cylinder block 21, crank chamber 22 formed between cylinder block 21 and front end plate 23, and rear end plate 24 attached to the other end of cylinder block 21. Front end plate 23 is mounted on cylinder block 21 forward of crank chamber 22 by a plurality of bolts 101. Rear end plate 24 is mounted on cylinder block 21 at its opposite end by a plurality of bolts 102. Valve plate 25 is located between rear end plate 24 and cylinder block 21. Opening 231 is centrally formed in front end plate 23 for supporting drive shaft 26. Drive shaft 26 is supported by bearing 30 disposed in opening 231. The inner end portion of drive shaft 26 is rotatably supported by bearing 31 disposed within central bore 210 of cylinder block 21. Bore 210 extends to a rearward end surface of cylinder block 21 and has disposed within it valve control mechanism 19 which is discussed below.

Cam rotor 40 is fixed on drive shaft 26 by pin member 261 and rotates with drive shaft 26. Thrust needle bearing 32 is disposed between the inner end surface of front end plate 23 and the adjacent axial end surface of cam rotor 40. Cam rotor 40 includes arm 41 having pin member 42 extending therefrom. Slant plate 50 is adjacent cam rotor 40 and includes opening 53 through which passes drive shaft 26. Slant plate 50 includes arm 51 having slot 52. Cam rotor 40 and slant plate 50 are connected by pin member 42, which is inserted in slot 52 to create a hinged joint. Pin member 42 is slidable within slot 52 to allow adjustment of the angular position of slant plate 50 with respect to a plane perpendicular to the longitudinal axis of drive shaft 26.

Wobble plate 60 is rotatably mounted on slant plate 50 through bearings 61 and 62. Fork shaped slider 63 is attached to the outer peripheral end of wobble plate 60 and is slidably mounted on sliding rail 64. Sliding rail 64 is held between front end plate 23 and cylinder block 21. Fork shaped slider 63 prevents rotation of wobble plate 60 and, thus, wobble plate 60 nutates along rail 64 when cam rotor 40 rotates. Cylinder block 21 includes a plurality of peripherally located cylinder chambers 70 in which pistons 71 reciprocate. Each piston 71 is connected to wobble plate 60 by a corresponding connecting rod 72.

Rear end plate 24 includes peripherally located annular suction chamber 241 and centrally located discharge chamber 251. Valve plate 25 is located between cylinder block 21 and rear end plate 24 and includes a plurality of valved suction ports 242 linking suction chamber 241 with respective cylinders 70. Valve plate 25 also includes a plurality of valved discharge ports 252 linking discharge chamber 251 with respective cylinders 70. Suction ports 242 and discharge ports 252 are provided with suitable reed valves as described in U.S. Pat. No. 4,001,029 to Shimizu.

Suction chamber 241 includes inlet portion **241*a* which is connected to an evaporator of the external cooling circuit (not shown). Discharge chamber 251 is provided with outlet portion 251*a* which is connected to a condenser of the cooling circuit (not shown). Gaskets 27 and 28 are located between cylinder block 21 and the front surface of valve plate 25, and between the rear surface of valve plate 25 and rear end plate 24, respectively. Gaskets 27 and 28 seal the mating surfaces of cylinder block 21, valve plate 25 and rear end plate 24**.

With further reference to FIG. 2, valve control mechanism 19 includes cup-shaped casing member 191 defining valve chamber 192 therewithin. O-ring **19*a* is disposed between an outer surface of casing member 191 and an inner surface of bore 210 to seal the mating surfaces of casing member 191 and cylinder block 21. A plurality of holes 19*a* are formed in the closed end (to the left in FIGS. 1 and 2) of casing member 191 to let crank chamber pressure into valve chamber 192 through a gap 31*a* existing between bearing 31 and cylinder block 21. Bellows 193 is disposed in valve chamber 192 to longitudinally contract and expand in response to crank chamber pressure. Projection member 193*b* is attached at a forward end of bellows 193 and is secured to axial projection 19*c* formed at a center of the closed end of casing member 191. Valve member 193*a* is attached at a rearward end of bellows 193**.

Cylinder member 194, including valve seat **194*a*, penetrates a center of valve plate assembly 200. Valve plate assembly 200 includes valve plate 25, gaskets 27 and 28, suction reed valve 271 and discharge reed valve 281. Valve seat 194*a* is formed at a forward end of cylinder member 194 and is secured to an opened end of casing member 191. Nuts 100 are screwed on cylinder member 194 from a rearward end of cylinder member 194 located in discharge chamber 251 to fix cylinder member 194 to valve plate assembly 200 and valve retainer 253. Conical shaped opening 194*b*, which receives valve member 193*a*, is formed at valve seat 194*a* and is linked to cylindrical bore 194*c* axially formed in cylinder member 194. Consequently, annular ridge 194*d* is formed at a location which is the boundary between conical shaped opening 194*b* and cylindrical bore 194*c*. Actuating rod 195 is slidably disposed within cylindrical bore 194*c*, slightly projects from the rearward end of cylindrical bore 194*c*, and is linked to valve member 193*a* through bias spring 196. Bias spring 196 smoothly transmits the force from actuating rod 195 to valve member 193*a* of bellows 193. Actuating rod 195 includes annular flange 195*a* which is integral with and radially extends from an outer surface of a front end portion of actuating rod 195. Annular flange 195*a* is located in conical shaped opening 194*b*, and prevents excessive rearward movement of actuating rod 195 by coming into contact with annular ridge 194*d*. O-ring 197 is compressedly mounted about actuating rod 195 to seal the mating surfaces of cylindrical bore 194*c* and actuating rod 195, thereby preventing the intrusion of the refrigerant gas from discharge chamber 251 into conical shaped opening 194b via the gap created between cylindrical bore 194c and rod 195**.

Radial hole 151 is formed at valve seat 194a to link conical shaped opening 194b to one end opening of conduit 152 formed in cylinder block 21. Conduit 152 includes cavity 152a and also is linked to suction chamber 242 through hole 153 formed in valve plate assembly 200. Passageway 150, which provides communication between crank chamber 22 and suction chamber 241, is formed by uniting gap 31a, bore 210, holes 19b, valve chamber 192, conical shaped opening 194b, radial hole 151, conduit 152 and hole 153.

As a result, the opening and closing of passageway 150 is controlled by the contracting and expanding of bellows 193 in response to crank chamber pressure.

During the operation of compressor 10, drive shaft 26 is rotated by the engine of the vehicle through electromagnetic clutch 300. Cam rotor 40 is rotated with drive shaft 26. Thus, slant plate 50 is also rotated, which causes wobble plate 60 to nutate. Nutational motion of wobble plate 60 reciprocates pistons 71 in their respective cylinders 70. As pistons 71 are reciprocated, refrigerant gas which is introduced into suction chamber 241 through inlet portion 241a, flows into each chamber 70 through suction ports 242 and is then compressed. The compressed refrigerant gas is discharged into discharge chamber 251 from each cylinder 70 through discharge ports 252, and therefrom flows into the cooling circuit through outlet portion 251a.

The capacity of compressor 10 is adjusted to maintain a constant pressure in suction chamber 241 in response to a change in the heat load on the evaporator or a change in the rotating speed of the compressor. The capacity of the compressor is adjusted by changing the angle of the slant plate which is dependent upon the pressure in the crank chamber relative to the pressure in the suction chamber. An increase in crank chamber pressure relative to the suction chamber pressure decreases the slant angle of the slant plate and the wobble plate, thus decreasing the capacity of the compressor. A decrease in the crank chamber pressure relative to the suction chamber pressure increases the angle of the slant plate and the wobble plate and, thus, increases the capacity of the compressor.

The purpose of valve control mechanism 19 of the prior art compressor is to maintain a constant pressure at the outlet of the evaporator during capacity control of the compressor. Valve control mechanism 19 operates in the following manner. Actuating rod 195 pushes valve member 193a in the direction to contract bellows 193 through bias spring 196. Actuating rod 195 is moved in response to receiving pressure in discharge chamber 251. Accordingly, increasing pressure in discharge chamber 251 further moves rod 195 toward bellows 193, thereby increasing the tendency of bellows 193 to contract. As a result, the compressor control point for displacement change is shifted to maintain a constant pressure at the evaporator outlet portion. That is, the valve control mechanism 19 makes use of the fact that the discharge pressure of the compressor is roughly directly proportional to the suction flow rate. Since actuating rod 195 moves in direct response to changes in discharge pressure and applies a force directly to the bellows 193 (the controlling valve element), the control point at which bellows 193 operates is shifted in a very direct and responsive manner by changes in discharge pressure.

In the construction of valve control mechanism 19 of the prior art compressor, O-ring 197 is compressedly mounted about actuating rod 195. Therefore, rod 195 frictionally slides through O-ring 197 in the operation of valve control mechanism 19. This causes the sliding movement of rod 195 within cylindrical bore 194c to be affected by frictional forces between O-ring 197 and rod 195, thereby producing a relationship between the suction chamber pressure and the discharge chamber pressure as illustrated in FIG. 8.

With reference to FIG. 8, line $l_0$ shows the relationship between the suction chamber pressure and the discharge chamber pressure in an ideal condition (i.e., rod 195 slides within cylinder 194c with no sliding friction). Line $l_1$ shows the relationship between the suction chamber pressure and the discharge chamber pressure in a discharge chamber pressure increasing stage. Line $l_2$ shows the relationship between the suction chamber pressure and the discharge chamber pressure in a discharge chamber pressure decreasing stage. Line $l_1$ is parallel to line $l_0$ by the horizontal distance of $\Delta P_{d1}$ along the abscissa, and line $l_2$ is parallel to line $l_0$ by the horizontal distance of $\Delta P_{d2}$ along the abscissa. Distance $\Delta P_{d1}$ is equal to distance $\Delta P_{d2}$.

In the discharge chamber pressure increasing stage, the discharge chamber pressure will be increased from the discharge chamber pressure in the ideal condition by $\Delta P_{d1}$ in order to compensate for the sliding friction force generated between rod 195 and O-ring 197. The increased increment $\Delta P_{d1}$ is necessary to locate rod 195 in the same position that rod 195 would be in the ideal condition, to thereby obtain the same suction chamber pressure as in the ideal condition. In other words, in order to obtain suction chamber pressure $P_{s0}$, the discharge chamber pressure is required to be $P_{d1}$. However, in the ideal condition, discharge chamber pressure $P_{d1}$ obtains suction chamber pressure $P_{s1}$.

On the other hand, in the discharge chamber pressure decreasing stage, the discharge chamber pressure will be decreased from the discharge chamber pressure in the ideal condition by $\Delta P_{d2}$ in order to compensate for the sliding friction force generated between rod 195 and O-ring 197. The decreased increment $\Delta P_{d2}$ is necessary to locate rod 195 in the same position that rod 195 would be in the ideal condition, to thereby obtain the same suction chamber pressure as in the ideal condition. In other words, in order to obtain suction chamber pressure $P_{s0}$, the discharge chamber pressure is required to be $P_{d2}$. However, in the ideal condition, discharge chamber pressure $P_{d2}$ obtains suction chamber pressure $P_{s2}$.

As described above, in both the discharge chamber pressure increasing and decreasing stages, the suction chamber pressure in the ideal condition is obtained at a certain discharge chamber pressure, the value of which is different than the value of the discharge chamber pressure in the ideal condition. As a result, the valve control mechanism according to the prior art compressor does not compensate with as high a degree of sensitivity as it could for the increase in pressure at the evaporator outlet when the capacity of the compressor is adjusted, in order to maintain a constant evaporator outlet pressure.

SUMMARY OF THE INVENTION

It is an object of this invention to provide a slant plate type piston compressor having a capacity adjusting mechanism which compensates for the increase in pressure at the evaporator outlet when the capacity of the compressor is adjusted. It is a further objective of this invention to maintain a constant evaporator outlet pressure with a control mechanism having a simple structure that operates in a direct and sensitive responsive manner.

A slant plate type compressor in accordance with one embodiment of the present invention includes a compressor housing having a front plate at one of its ends and a rear end plate at its other end. A crank chamber and a cylinder block are located in the housing, and a plurality of cylinders are formed in the cylinder block. A piston is slidably fitted within each of the cylinders and is reciprocated by a driving mechanism. The driving mechanism includes a drive shaft, a drive rotor coupled to the drive shaft and rotatable therewith, and a coupling mechanism which drivingly couples the rotor to the pistons such that the rotary motion of the rotor is converted to reciprocating motion of the pistons. The coupling mechanism includes a member which has a surface disposed at an incline angle relative to a plane perpendicular to the axis of the drive shaft. The incline angle of the member is adjustable to vary the stroke length of the reciprocating pistons and thus vary the capacity or displacement of the compressor. The rear end plate surrounds a suction chamber and a discharge chamber. A passageway provides fluid communication betwen the crank chamber and the suction chamber. An incline angle control device is supported in the compressor and controls the incline angle of the coupling mechanism member in response to changes in the crank chamber pressure relative to the suction chamber pressure.

A valve control mechanism includes a longitudinally expanding and contracting first bellows responsive to the crank member pressure and a valve member attached at one end of the first bellows to open and close the passageway. The valve control mechanism further includes a second bellows responsive to the discharge chamber pressure so as to longitudinally move and thereby apply a force to and move the valve member to shift the control point of the first bellows in response to changes in the discharge chamber pressure.

DETAILED DESCRIPTION OF THE PREFERRED EMBODIMENTS

Figure 2:
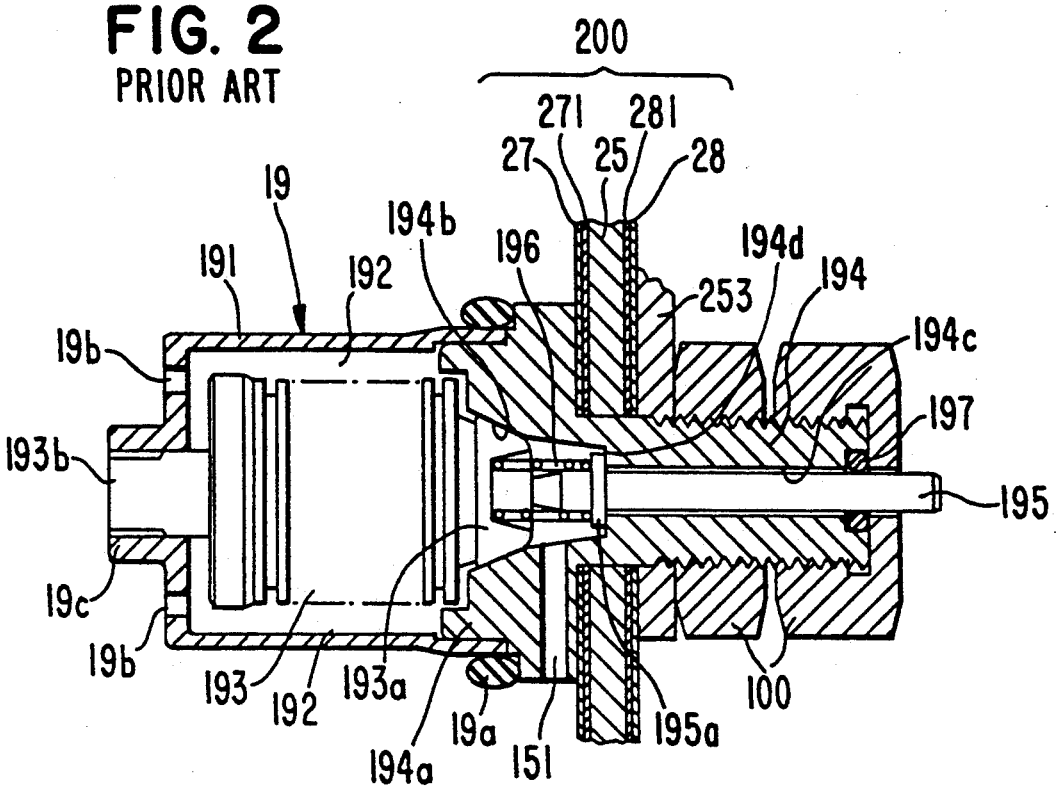
FIG. 2 PRIOR ART
FIG. 2 illustrates an enlarged partially sectional view of a valve control mechanism shown in FIG. 1.
Figure 4:
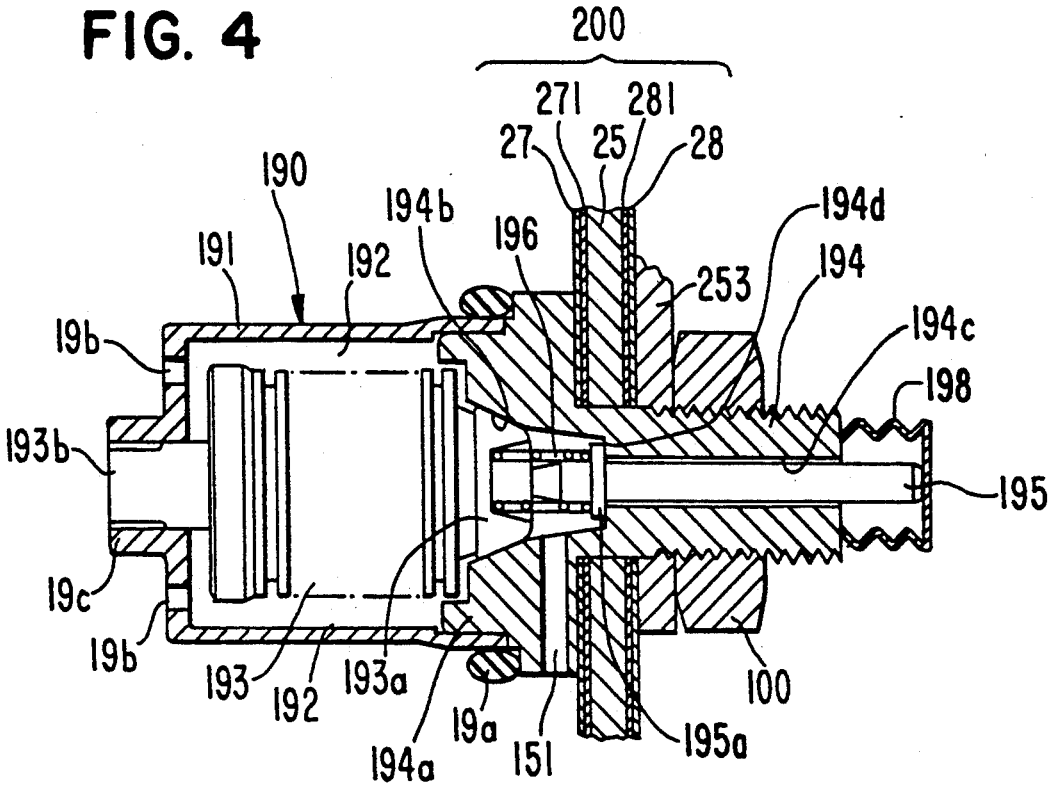
FIG. 4 illustrates an enlarged partially sectional view of a valve control mechanism shown in FIG. 3.
Figure 3:
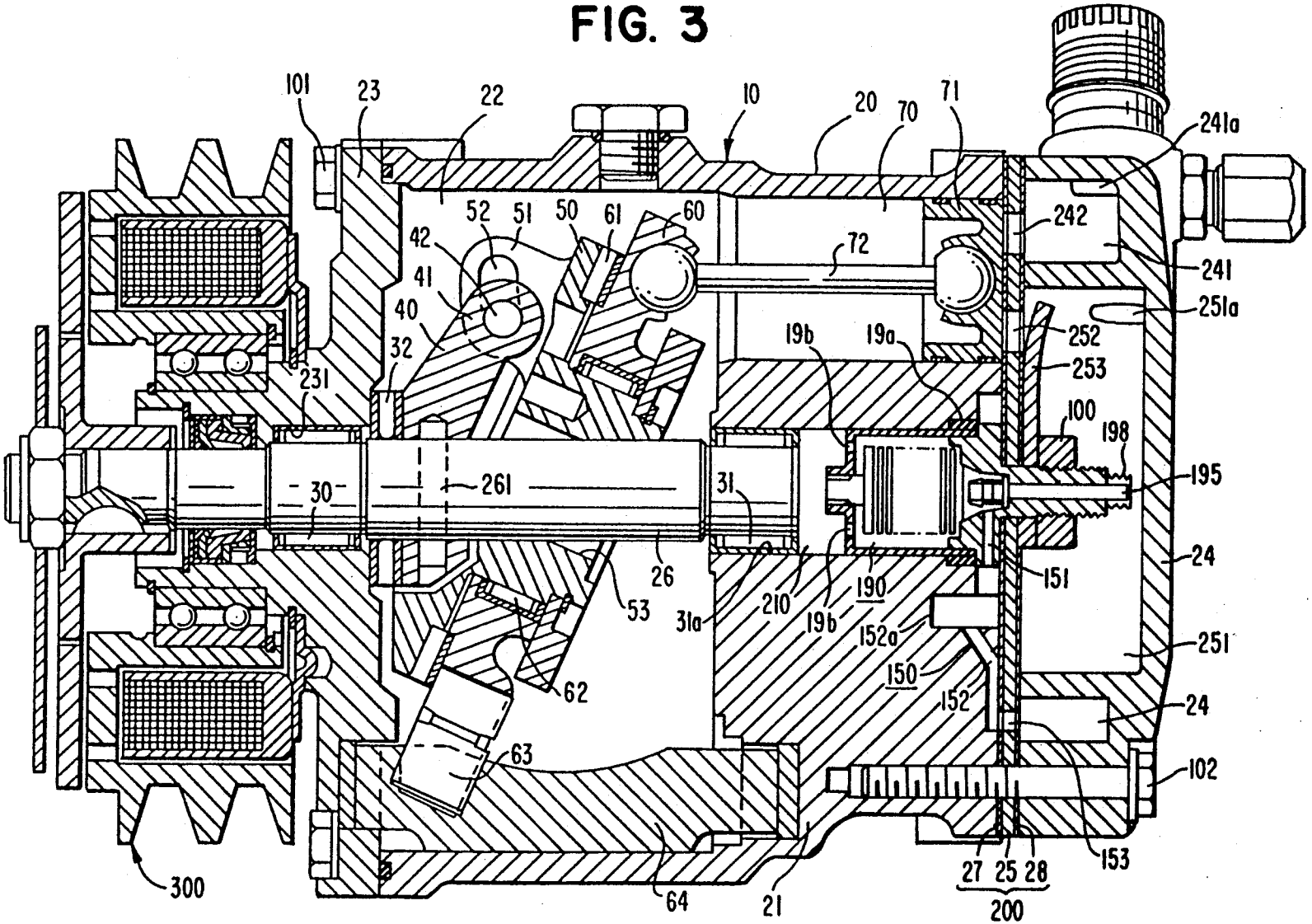
FIG. 3 illustrates a vertical longitudinal sectional view of a wobble plate type refrigerant compressor in accordance with a first embodiment of the present invention.

FIGS. 3 and 4 illustrate a first embodiment of the present invention. In the drawing, the same numerals are used to denote the same elements shown in FIGS. 1 and 2. Furthermore, for purposes of explanation only, the left side of the Figures will be referenced as the forward end or front end and the right side of the Figures will be referenced as the rearward end.

In the construction of valve control mechanism 190 in accordance with the first embodiment, auxiliary cup-shaped bellows 198 is made of an elastic material, such as phosphor bronze, and is disposed in discharge chamber 251. An open end of auxiliary bellows 198 is hermetically connected to a rear end surface of cylindrical bore 194 by, for example, brazing. The axial length of auxiliary bellows 198, in a relaxed condition, is designed so as to allow non-compressed contact between the rear end surface of actuating rod 195 and the inner surface of a bottom portion of auxiliary cup-shaped bellows 198 when annular flange 195*a* is in contact with annular ridge 194*d*. In addition, the value of the effective pressure receiving area of bellows 198 is designed so as to be equal to the value of the effective pressure receiving area of prior art actuating rod 195 shown in FIGS. 1 and 2.

Since the cooling circuit is charged with the refrigerant after evacuating thereof, an inner hollow space of auxiliary bellows 198 is filled with the charged refrigerant of the compressor. Once the compressor starts to operate, the refrigerant flowing frame crank chamber 22 past the gap created between valve member 193*a* and conical shaped opening 194*b* is conducted into the inner hollow space of auxiliary bellows 198 via the gap created between the outer peripheral surface of actuating rod 195 and the inner peripheral surface of cylindrical bore 194*c* while an intrusion of the refrigerant gas from discharge chamber 251 to conical shaped opening 194*b* is prevented.

During capacity control of the compressor, auxiliary bellows 198 axially contracts in response to receiving pressure in discharge chamber 251 so as to push actuating rod 195 in the direction to contact bellows 193 through bias spring 196. Accordingly, increasing pressure in discharge chamber 251 further contracts auxiliary bellows 198 so that actuating rod 195 further moves toward bellows 193, thereby increasing the tendency of bellows 193 to contract. As a result, the compressor control point for a displacement change is shifted to maintain a constant pressure at the evaporator outlet portion.

According to this embodiment, an O-ring compressedly mounted about actuating rod 195 can be removed while the intrusion of the refrigerant gas from discharge chamber 251 to conical shaped opening 194*b* via the gap created between cylindrical bore 194*c* and rod 195 is prevented. Therefore, the aforementioned defect caused in the prior art compressor can be eliminated.

Figure 5:
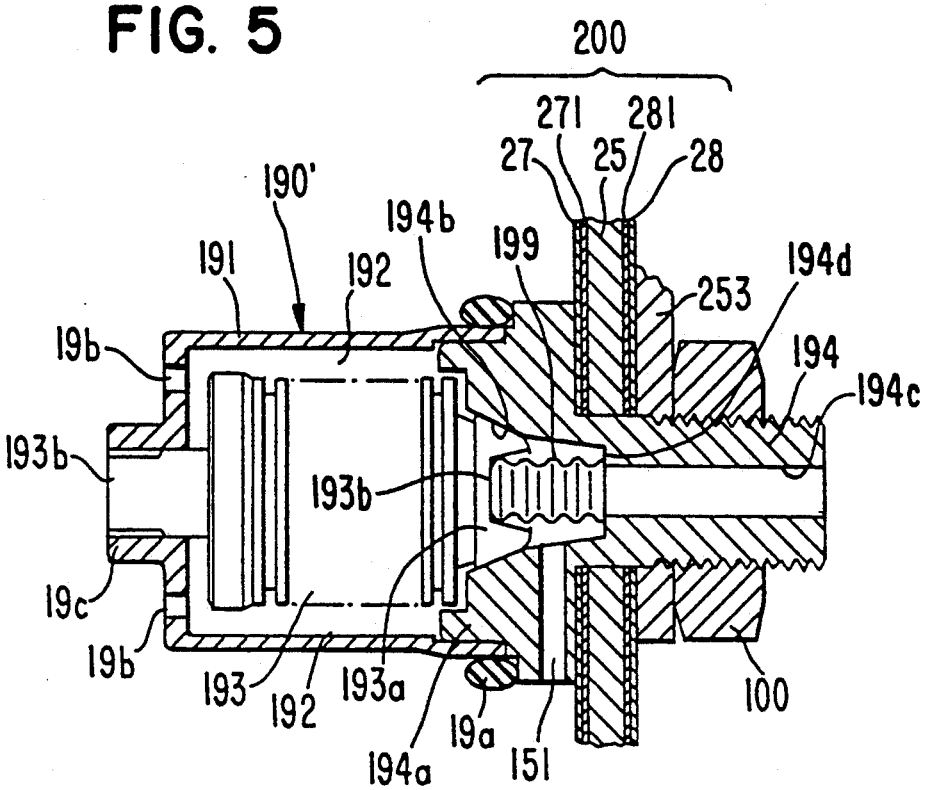
FIG. 5 illustrates a view similar to FIG. 4, showing a valve control mechanism in accordance with a second embodiment of the present invention.
Figure 6:
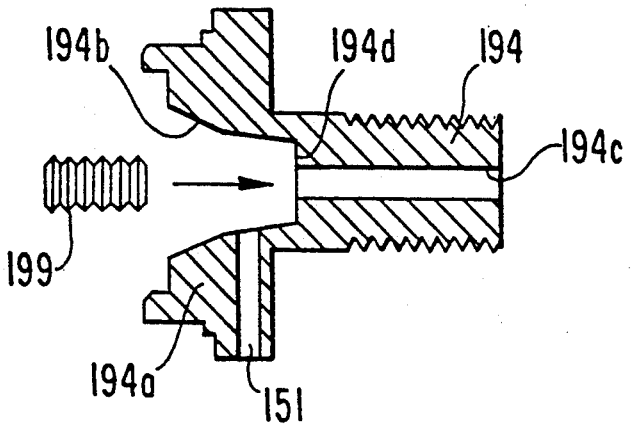
FIG. 6 illustrates an exploded view of a part of the valve control mechanism shown in FIG. 5.

FIG. 5 illustrates a second embodiment of the present invention. In this embodiment, actuating rod 195 and bias spring 196 shown in FIGS. 1–4 are removed. Auxiliary cup-shaped bellows 199 is made of an elastic material, such as phosphor bronze, and is compressedly disposed between the side wall of annular ridge 194*d* and the bottom surface of generally cylindrical-shaped depression 193*b* which is formed at a rear end of valve member 193*a*. An open end of auxiliary bellows 199 is hermetically connected to the side wall of annular ridge 194*d* by, for example, brazing as shown in FIG. 6. Accordingly, in operation of the compressor, the refrigerant gas in discharge chamber 251 is conducted into an inner hollow space of auxiliary bellows 199 via cylindrical bore 194*c* while the refrigerant gas flowing from crank chamber 22 past the gap created between valve member 193*a* and conical shaped opening 194*b* does not intrude into discharge chamber 251. According to this embodiment, a simply constructed valve control mechanism is obtained.

During capacity control of the compressor, auxiliary bellows 199 axially expands in response to receiving pressure in discharge chamber 251 so as to directly push valve member 193*a* in the direction to contract bellows 193. Accordingly, increasing pressure in discharge chamber 251 further axially expands auxiliary bellows 199 so that value member 193*a* further moves toward bellows 193, thereby increasing the tendency of bellows 193 to contract. As a result, the compressor control point for displacement change is shifted to maintain a constant pressure at the evaporator outlet portion.

Figure 1:
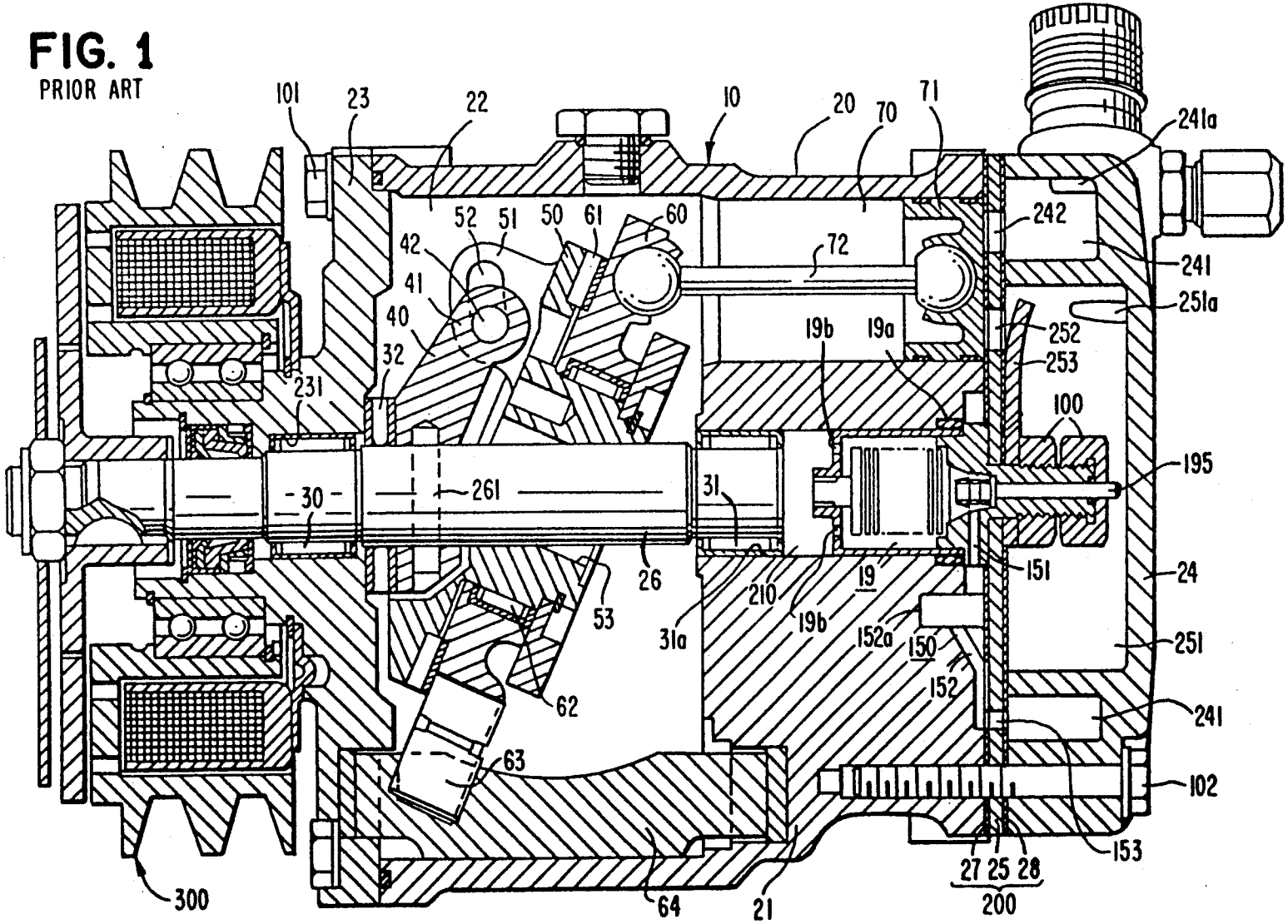
FIG. 1 PRIOR ART
FIG. 1 illustrates a vertical longitudinal sectional view of a wobble plate type refrigerant compressor in accordance with the prior art.

Furthermore, the value of the effective pressure receiving area of bellows 199 is designed so as to be equal to the value of the effective pressure receiving area of the prior art actuating rod 195 shown in FIGS. 1 and 2.

Still further, an auxiliary bellows having both axial ends open may be used in this embodiment, if both axial open ends are hermetically connected to the bottom end surface of depression 193*b* of valve member 193*a* and to the side wall of annular ridge 194*d*, respectively, or if both axial open ends can be maintained in fitly contact with the bottom surface of depression 193*b* of valve member 193*a* and the side wall of annular ridge 194*d*, respectively, so as to be able to effectively prevent leakage of the refrigerant gas from the inner hollow space of the auxiliary bellows 199 to conical shaped opening 194*b*.

Valve control mechanism 190' of the second embodiment is similar to valve control mechanism 190 of the first embodiment other than the above-mentioned aspects so that a further explanation thereof is omitted.

Figure 7:
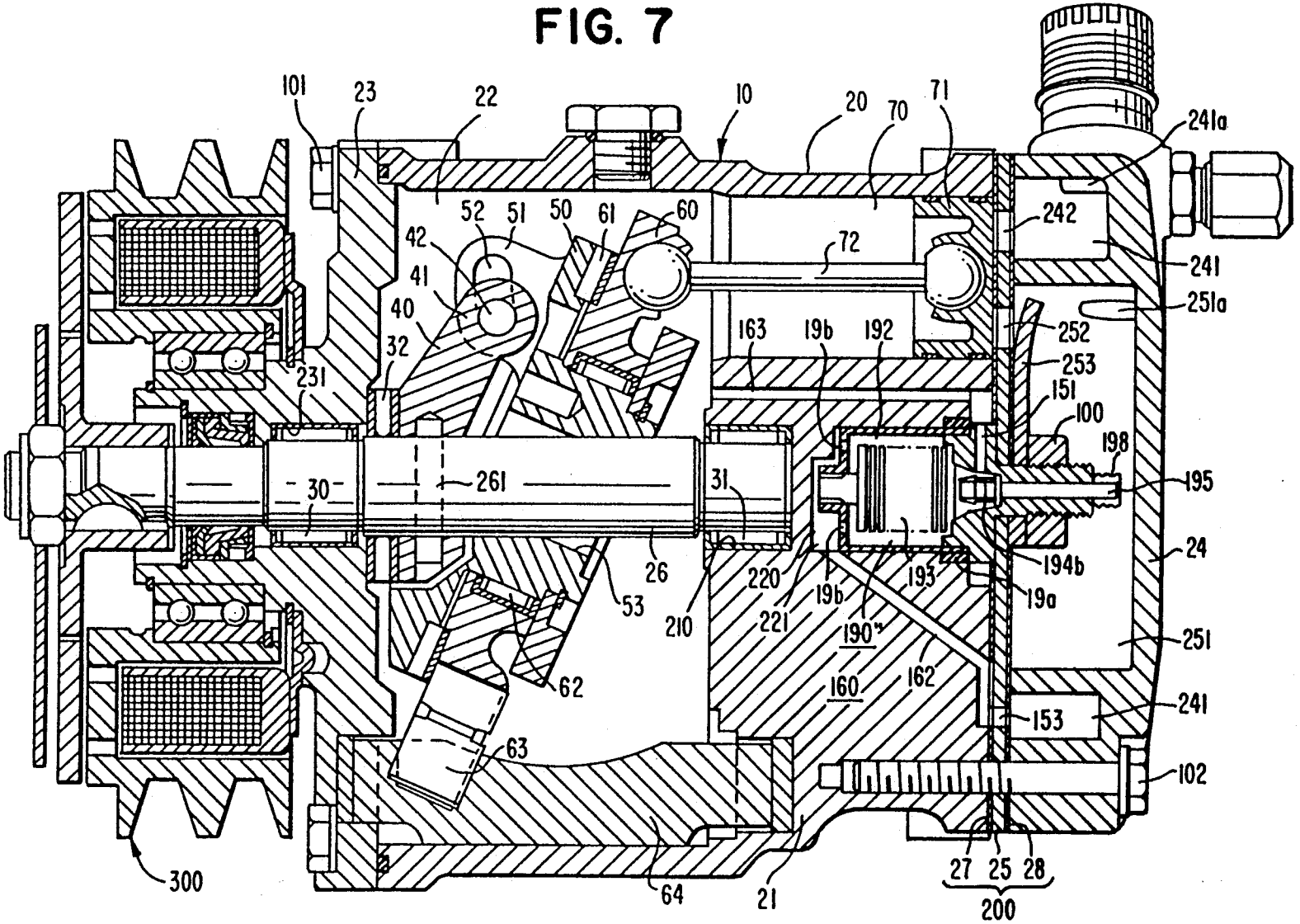
FIG. 7 illustrates a vertical longitudinal sectional view of a wobble plate type refrigerant compressor in accordance with a third embodiment of the present invention.
Figure 8:
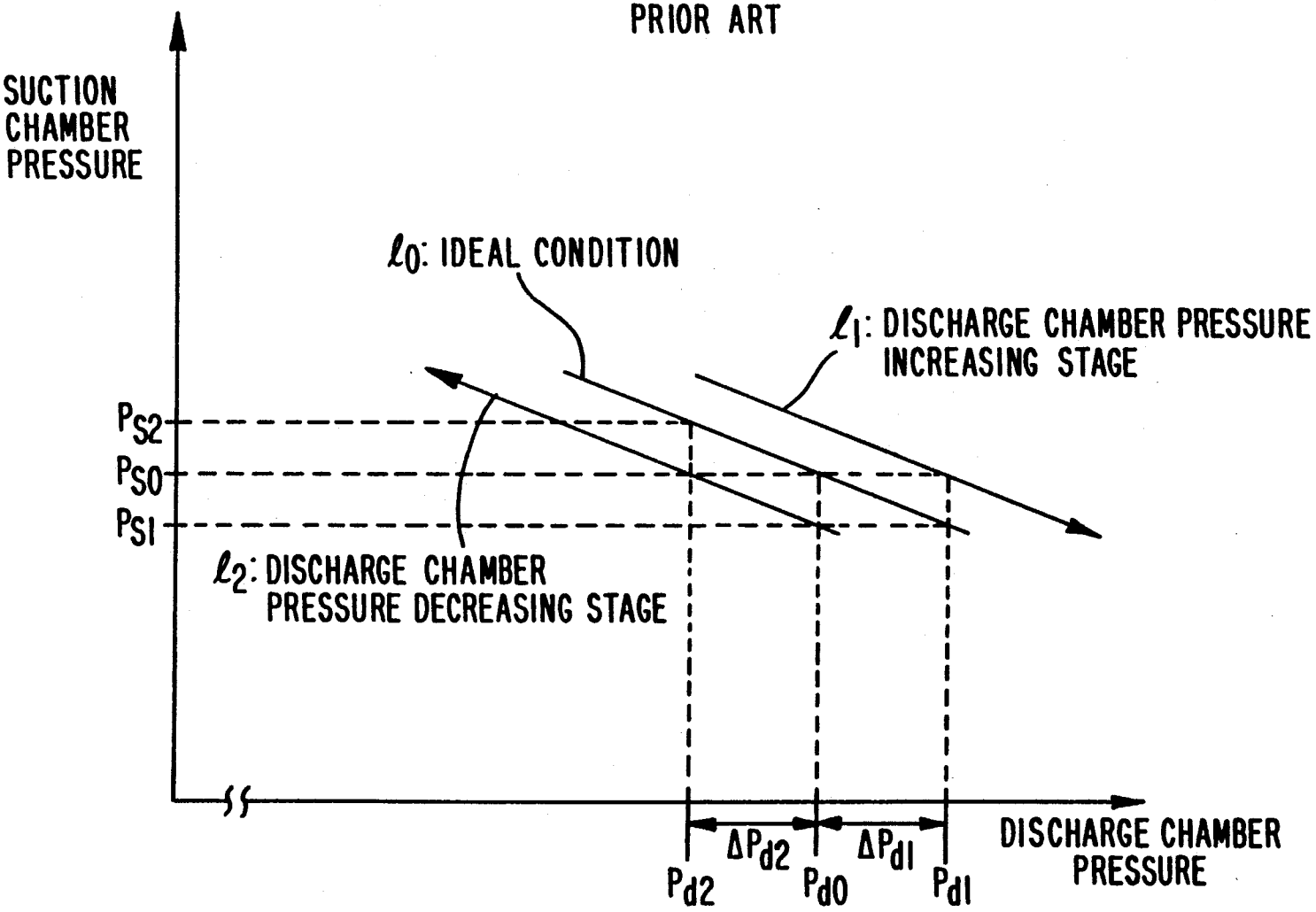
FIG. 8 PRIOR ART
FIG. 8 illustrates a graph showing a relationship between the suction chamber pressure and the discharge chamber pressure in operation of the prior art compressor of FIG. 1.

FIG. 7 illustrates a third embodiment of the present invention in which the same numerals are used to denote the same elements shown in FIGS. 3 and 4. In the third embodiment, cavity 220 in which valve control mechanism 190'' is disposed, is formed at a central portion of cylinder block 21 and is isolated from bore 210 which rotatably supports drive shaft 26. Holes 19*b* link valve chamber 192 to space 221 provided at the forward end of cavity 220. Conduit 162, which links space 221 to suction chamber 241 through hole 153, is formed in cylinder block 21 to let suction chamber pressure into space 221. Conduit 163, which links crank chamber 22 to radial hole 151, is also formed in cylinder block 21. Passageway 160, which communicates crank chamber 22 and suction chamber 241, is thus formed by uniting conduit 163, radial hole 151, conical shaped opening 194*b*, valve chamber 192, holes 19*b*, space 221, conduit 162 and hole 153. As a result, the opening and closing of passageway 160 is controlled by the contracting and expanding of bellows 193 in response to suction chamber pressure.

This invention has been described in detail in connection with the preferred embodiments. These embodiments, however, are merely for example only and the invention is not restricted thereto. It will be understood by those skilled in the art that other variations and modifications can easily be made within the scope of this invention as defined by the claims.

I claim:

1. A refrigerant compressor including a compressor housing having a cylinder block provided with a plurality of cylinders, a front end plate disposed on one end of said cylinder block and enclosing a crank chamber within said cylinder block, a piston slidably fitted within each of said cylinders and reciprocated by a drive mechanism including a motor connected to a drive shaft, an adjustable slant plate having an inclined surface adjustably connected to said rotor and having an adjustable slant angle with respect to a plane perpendicular to the axis of said drive shaft and coupling means for operationally coupling said slant plate to said pistons such that rotation of said drive shaft, rotor and slant plate reciprocates said pistons in said cylinders, said slant angle changing in response to a change in pressure in said crank chamber to change the capacity of said compressor, a rear end plate disposed on the opposite end of said cylinder block from said front end plate and defining a suction chamber, and a discharge chamber therein, a passageway linking said suction chamber with said crank chamber and a valve control means for controlling the opening and closing of said passageway, said valve control means comprising a longitudinally expanding and contracting first bellows primarily responsive to pressure in said crank chamber and a valve member attached at one end of said first bellows to open and close said passageway, the improvement comprising:

a second bellows operatively connected to said first bellows, said second bellows receiving the discharge chamber pressure so as to longitudinally move and thereby apply a force to and move said valve member to shift the control point of said first bellows in response to pressure changes in said discharge chamber, said second bellows transferring the force to said valve member without contacting the wall of said passageway thus minimizing frictional resistance.

2. The refrigerant compressor of claim 1, wherein said second bellows is made of phosphor bronze.

3. The refrigerant compressor of claim 1, said second bellows operatively connected to said first bellows through a connecting rod and said valve means.

4. A refrigerant compressor including a compressor housing having a cylinder block provided with a plurality of cylinders, a front end plate disposed on one end of said cylinder block and enclosing a crank chamber within said cylinder block, a piston slidably fitted within each of said cylinders and reciprocated by a drive mechanism including a rotor connected to a drive shaft, an adjustable slant plate having an inclined surface adjustably connected to said rotor and having an adjustable slant angle with respect to a plane perpendicular to the axis of said drive shaft and coupling means for operationally coupling said slant plate to said pistons such that rotation of said drive shaft, rotor and slant plate reciprocates said pistons in said cylinders, said slant angle changing in response to a change in pressure in said crank chamber to change the capacity of said compressor, a rear end plate disposed on the opposite end of said cylinder block from said front end plate and defining a suction chamber and a discharge chamber therein, a passageway linking said suction chamber with said crank chamber and a valve control means for controlling the opening and closing of said passageway, said valve control means comprising a longitudinally expanding and contracting first bellows primarily responsive to pressure in said crank chamber and a valve member attached at one end of said first bellows to open and close said passageway, the improvement comprising:

a second bellows operatively connected to said first bellows, said second bellows receiving the discharge chamber pressure so as to longitudinally move and thereby apply a force to and move said valve member to shift the control point of said first bellows in response to pressure changes in said discharge chamber;

a cylinder member having a first end adjacent to said valve member and a second end to which one end of said second bellows is sealingly connected so that an intrusion of the discharge chamber pressure into said passageway is prevented; and an actuating rod slidably disposed within said cylinder member, said actuating rod having two ends, said first end operatively coupled to said valve member and said second end operatively coupled to said second bellows, said actuating rod transmitting the force from said second bellows to said valve member.

5. The refrigerant compressor of claim 4, further comprising a spring disposed between said first end of said actuating rod and said valve means.

6. A refrigerant compressor including a compressor housing having a cylinder block provided with a plurality of cylinders, a front end plate disposed on one end of said cylinder block and enclosing a crank chamber within said cylinder block, a piston slidably fitted within each of said cylinders and reciprocated by a drive mechanism including a rotor connected to a drive shaft, an adjustable slant plate having an inclined surface adjustably connected to said rotor and having an adjustable slant angle with respect to a plane perpendicular to the axis of said drive shaft and coupling means for operationally coupling said slant plate to said pistons such that rotation of said drive shaft, rotor and slant plate reciprocates said pistons in said cylinders, said slant angle changing in response to a change in pressure in said crank chamber to change the capacity of said compressor, a rear end plate disposed on the opposite end of said cylinder block from said front end plate and defining a suction chamber and a discharge chamber therein, a passageway linking said suction chamber with said crank chamber and a valve control means for controlling the opening and closing of said passageway, said valve control means comprising a longitudinally expanding and contracting first bellows primarily responsive to pressure in said crank chamber and a valve member attached at one end of said first bellows to open and close said passageway, the improvement comprising:

a second bellows operatively connected to said first bellows, said second bellows receiving the discharge chamber pressure so as to longitudinally move and thereby apply a force to and move said valve member to shift the control point of said first bellows in response to pressure changes in said discharge chamber; and a bore with a first end opening into said second bellows and a second end opening into said discharge chamber whereby discharge chamber pressure is conducted into said second bellows through said bore, said second bellows having two ends, one of which is supplied with discharge chamber pressure and the other of which contacts said valve member.

7. The refrigerant compressor of claim 6, wherein the other end of said second bellows is closed.

8. The refrigerant compressor of claim 6, wherein the other end of said second bellows is sealingly connected to said valve member.

9. The refrigerant compressor of claim 6, wherein the other end of said second bellows is in compressed contact with said valve member.

10. A refrigerant compressor including a compressor housing having a cylinder block provided with a plurality of cylinders, a front end plate disposed on one end of said cylinder block and enclosing a crank chamber within said cylinder block, a piston slidably fitted within each of said cylinders and reciprocated by a drive mechanism including a rotor connected to a drive shaft, an adjustable slant plate having an inclined surface adjustably connected to said rotor and having an adjustable slant angle with respect to a plane perpendicular to the axis of said drive shaft, and coupling means for operationally coupling said slant plate to said pistons such that rotation of said drive shaft, rotor and slant plate reciprocate said pistons in said cylinders, said slant angle changing in response to a change in pressure in said crank chamber to change the capacity of said compressor, a rear end plate disposed on the opposite end of said cylinder block from said front end plate and defining a suction chamber and a discharge chamber therein, a passageway linking said suction chamber with said crank chamber and a valve control means for controlling the opening and closing of said passageway, said valve control means comprising a longitudinally expanding and contracting first bellows primarily responsive to pressure in said suction chamber and a valve member attached at one end of said first bellows to open and close said passageway, the improvement comprising:

a second bellows operatively connected to said first bellows, said second bellows receiving the discharge chamber pressure so as to longitudinally move and thereby apply a force to and move said valve member to shift the control point of said first bellows in response to pressure changes in said discharge chamber, said second bellows transferring the force to said valve member without contacting the wall of said passageway thus minimizing frictional resistance.

11. The refrigerant compressor of claim 10, wherein said second bellows is made of phosphor bronze.

12. The refrigerant compressor of claim 10, said second bellows operatively connected to said first bellows through a connecting rod and said valve means.

13. A refrigerant compressor including a compressor housing having a cylinder block provided with a plurality of cylinders, a front end plate disposed on one end of said cylinder block and enclosing a crank chamber within said cylinder block, a piston slidably fitted within each of said cylinders and reciprocated by a drive mechanism including a rotor connected to a drive shaft, an adjustable slant plate having an inclined surface adjustably connected to said rotor and having an adjustable slant angle with respect to a plane perpendicular to the axis of said drive shaft, and coupling means for operationally coupling said slant plate to said pistons such that rotation of said drive shaft, rotor and slant plate reciprocates said pistons in said cylinders, said slant angle changing in response to a change in pressure in said crank chamber to change the capacity of said compressor, a rear end plate disposed on the opposite end of said cylinder block from said front end plate and defining a suction chamber and a discharge chamber therein, a passageway linking said suction chamber with said crank chamber and a valve control means for controlling the opening and closing of said passageway, said valve control means comprising a longitudinally expanding and contracting first bellows primarily responsive to pressure in said suction chamber and a valve member attached at one end of said first bellows to open and close said passageway, the improvement comprising:

a second bellows operatively connected to said first bellows, said second bellows receiving the discharge chamber pressure so as to longitudinally move and thereby apply a force to and move said valve member to shift the control point of said first bellows in response to pressure changes in said discharge chamber;

a cylinder member having a first end adjacent to said valve member and a second end to which one end of said second bellows is sealingly connected so that an intrusion of the discharge chamber pressure into said passageway is prevented; and an actuating rod slidably disposed within said cylinder member, said actuating rod having two ends, said first end operatively coupled to said valve member and said second end operatively coupled to said second bellows, said actuating rod transmitting the force from said second bellows to said valve member.

14. The refrigerant compressor of claim 13, further comprising a spring disposed between said first end of said actuating rod and said valve means.

15. A refrigerant compressor including a compressor housing having a cylinder block provided with a plurality of cylinders, a front end plate disposed on one end of said cylinder block and enclosing a crank chamber within said cylinder block, a piston slidably fitted within each of said cylinders and reciprocated by a drive mechanism including a rotor connected to a drive shaft, an adjustable slant plate having an inclined surface adjustably connected to said rotor and having an adjustable slant angle with respect to a plane perpendicular to the axis of said drive shaft, and coupling means for operationally coupling said slant plate to said pistons such that rotation of said drive shaft, rotor and slant plate reciprocates said pistons in said cylinders, said slant angle changing in response to a change in pressure in said crank chamber to change the capacity of said compressor, a rear end plate disposed on the opposite end of said cylinder block from said front end plate and defining a suction chamber and a discharge chamber therein, a passageway linking said suction chamber with said crank chamber and a valve control means for controlling the opening and closing of said passageway, said valve control means comprising a longitudinally expanding and contracting first bellows primarily responsive to pressure in said suction chamber and a valve member attached at one end of said first bellows to open and close said passageway, the improvement comprising:

a second bellows operatively connected to said first bellows, said second bellows receiving the discharge chamber pressure so as to longitudinally move and thereby apply a force to and move said valve member to shift the control point of said first bellows in response to pressure changes in said discharge chamber; and a bore with a first end opening into said second bellows and a second end opening into said discharge chamber whereby discharge chamber pressure is conducted into said second bellows through said bore, said second bellows having two ends, one of which is supplied with discharge chamber pressure and the other of which contacts said valve member.

16. The refrigerant compressor of claim 15, wherein the other end of said second bellows is closed.

17. The refrigerant compressor of claim 15, wherein the other end of said second bellows is sealingly connected to said valve member.

18. The refrigerant compressor of claim 15, wherein the other end of said second bellows is in compressed contact with said valve member.

19. A refrigerant compressor comprising:

a housing having a plurality of cylinders formed therein;

a front end plate disposed on one end of said housing and forming a crank chamber with said housing;

a plurality of pistons fitted within said cylinders;

drive means for reciprocating said pistons within said cylinders;

a rear end plate disposed opposite to said front end plate on said housing and defining a suction chamber and a discharge chamber; and variable capacity means for adjusting the capacity of the compressor including:

a passageway connecting the suction chamber and the crank chamber, and valve control means for regulating said passageway, said valve control means including a first bellows with a valve member attached thereon for opening and closing said passageway and bellows means operatively connected to said first bellows, said bellows means responsive to the pressure in the discharge chamber for adjusting the control point of said first bellows in response to the discharge chamber pressure, said bellows means applying a force to said valve member without contacting the wall of said passageway thus minimizing frictional resistance.

20. The refrigerant compressor of claim 19, wherein said first bellows is responsive to the pressure in said crank chamber.

21. The refrigerant compressor of claim 19, wherein said first bellows is responsive to a pressure in said suction chamber.

22. The refrigerant compressor of claim 19, said bellows means operatively connected to said first bellows through a connecting rod and said valve means.

23. A refrigerant compressor comprising:

a housing having a plurality of cylinders formed therein;

a front end plate disposed on one end of said housing and forming a crank chamber with said housing;

a plurality of pistons fitted within said cylinders;

drive means for reciprocating said pistons within said cylinders;

a rear end plate disposed opposite to said front end plate on said housing and defining a suction chamber and a discharge chamber; and variable capacity means for adjusting the capacity of the compressor including:

a passageway connecting the suction chamber and the crank chamber, and valve control means for regulating said passageway, said valve control means including a first bellows with a valve member attached thereon for opening and closing said passageway and bellows means operatively connected to said first bellows, said bellows means responsive to the pressure in the discharge chamber for adjusting the control point of said first bellows in response to the discharge chamber pressure; wherein said bellows means including a second bellows for receiving the discharge chamber pressure and a rod having one end linked to said valve member and another end in contact with said second bellows, so that the movement of said second bellows is transmitted to said valve member.

24. A refrigerant compressor comprising:

a housing having a plurality of cylinders formed therein;

a front end plate disposed on one end of said housing and forming a crank chamber with said housing;

a plurality of pistons fitted within said cylinders;

drive means for reciprocating said pistons within said cylinders;

a rear end plate disposed opposite to said front end plate on said housing and defining a suction chamber and a discharge chamber; and variable capacity means for adjusting the capacity of the compressor including:

a passageway connecting the suction chamber and the crank chamber, and valve control means for regulating said passageway, said valve control means including a first bellows with a valve member attached thereon for opening and closing said passageway and bellows means operatively connected to said first bellows, said bellows means responsive to the pressure in the discharge chamber for adjusting the control point of said first bellows in response to the discharge chamber pressure; wherein said bellows means including a second bellows for receiving the discharge chamber pressure and having one end in contact with said valve member, and a bore extending through said valve control means for supplying the discharge chamber pressure to said second bellows, so that the movement of said second bellows is transmitted directly to said valve member.

* * * * *